United States Patent [19]

Fritz et al.

[11] Patent Number: 4,581,132

[45] Date of Patent: Apr. 8, 1986

[54] SIFTER APPARATUS

[76] Inventors: Hermann Fritz, Brodersdorf 75; Erich Neuhold, Sandriegelweg 21; Richard Reder, Schiessstattg. 31, all of A 8200 Gleisdorf, Austria

[21] Appl. No.: 693,877

[22] Filed: Jan. 23, 1985

[30] Foreign Application Priority Data

Feb. 10, 1984 [AT] Austria ..... 439/84

[51] Int. Cl.[4] ..... B07B 1/28; B07B 1/49

[52] U.S. Cl. ..... 209/310

[58] Field of Search ..... 209/310, 326, 403, 405, 209/409, 412

[56] References Cited

U.S. PATENT DOCUMENTS

| | | | |
|---|---|---|---|
| 1,923,229 | 8/1933 | Robins | 209/326 |
| 3,647,068 | 3/1972 | Wehner | 209/310 |
| 3,971,715 | 7/1976 | Wehner | 209/310 |
| 4,064,051 | 12/1977 | Wehner | 209/310 X |
| 4,188,288 | 2/1980 | Wehner | 209/310 |
| 4,504,386 | 3/1985 | Dyren et al. | 209/405 X |

*Primary Examiner*—Frank W. Lutter
*Assistant Examiner*—Thomas M. Lithgow
*Attorney, Agent, or Firm*—Kurt Kelman

[57] ABSTRACT

A sifter apparatus comprises an oscillatory support comprising two side plates defining transversely aligned window openings at spaced locations along the side plates and first transverse bearing beams extending between the aligned window openings and connecting the side plates. Inertia is imparted to the oscillatory support by two side bearing beams extending along the two side plates and second transverse beams passing through the aligned window openings in the side plates and connecting the side bearing beams. Pairs of spring elements are connected to the side plates of the support at the spaced location, the two side bearing beams being gripped between the spring elements of each pair. Sifting mats are secured between respective ones of the first and second transverse beams.

4 Claims, 4 Drawing Figures

SIFTER APPARATUS

The invention relates to a sifter apparatus comprising a support which can be caused to oscillate and which comprises two side plates connected by first transverse bearing beams and an inertia means which is connected by way of spring elements to the support and which has two side bearing beams which are arranged at two sides of the side plates and connected by second transverse bearing beams, elastic sifting mats being gripped respectively between the first and second transverse bearing beams.

A sifter apparatus of that kind is disclosed for example in U.S. Pat. No. 4,188,288.

The object of the present invention is to provide an approximately linear oscillation of the sifting mats without the provision of guide means in a simple structural design.

In a sifter apparatus of the kind set forth hereinabove, this is achieved in accordance with the invention by gripping the side bearing beams in the longitudinal direction at a plurality of locations between two spring elements which are connected to the side plates, while the second transverse bearing beams are guided through window-like openings in the side plates.

The invention will now be described in greater detail with reference to the drawing in which.

Figure 1:
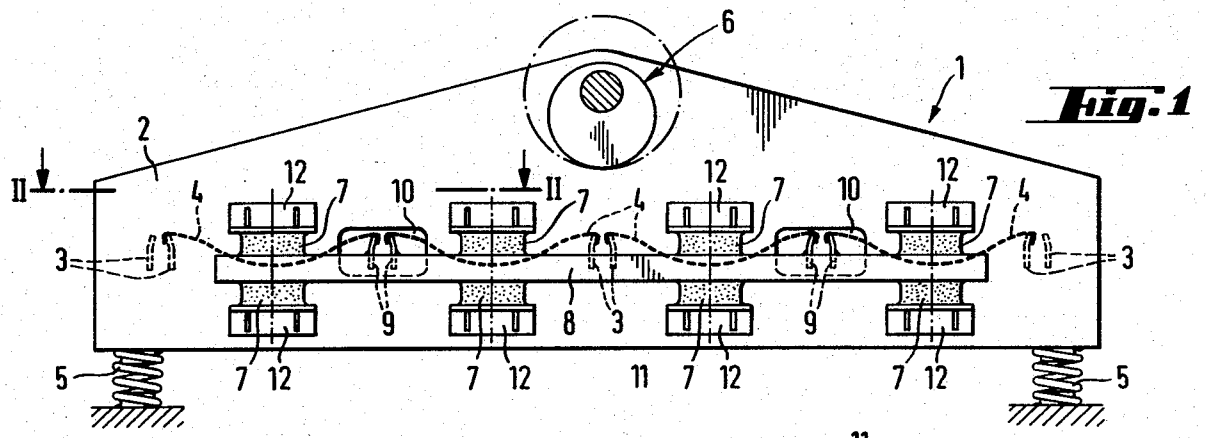
FIG. 1 shows a side view of a sifter apparatus according to the invention.
Figure 2:
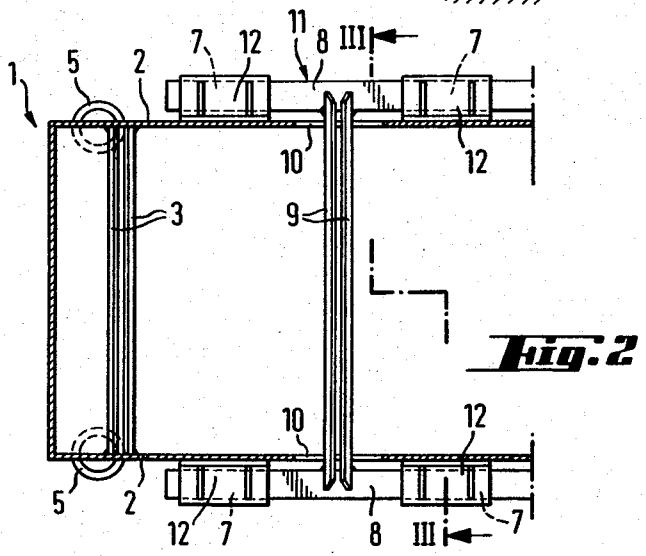
FIG. 2 shows a view of part of the apparatus in section taken along line II—II in FIG. 1, the sifting mats not being shown for the sake of improved clarity.
Figure 3:
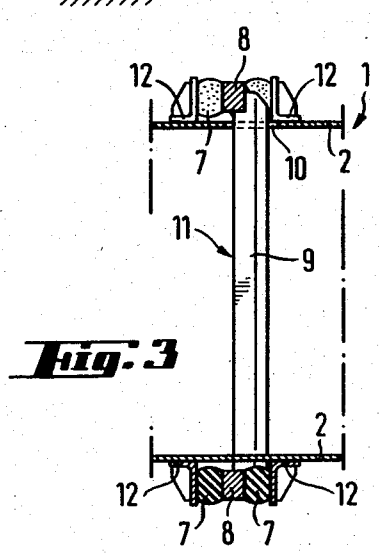
FIG. 3 shows a view in section taken along line III—III in FIG. 2.

In the embodiment shown in FIGS. 1 to 3, the support 1 comprises two side plates 2 which are connected in their end regions by first transverse bearing beams 3. The support 1 is supported on springs 5 and carries an oscillation generator 6 which may be, for example, a rotary oscillator. Pair of L-shaped members 12 are secured at a spacing to the outsides of the side plates 2.

A longitudinal bearing beam 8 is gripped by two spring elements 7 between the projecting limb portions of the pair of L-shaped members 12. The bearing beams 8 which are arranged at both sides of the side plates 2 are connected by transverse bearing beams 9 which pass through windows 10 in the side plates 2. The longitudinal bearing beams 8 and the transverse bearing beams 9 form an inertia means 11. The sifting mats 4 are secured between respective transverse bearing beams 3 and 9.

When the support 1 is caused to oscillate by the oscillation generator 6, the inertia of bearing beams 8 and 9 connected to the support by springs 7, causes this inertia means 11 to trail initially in its movement with respect to the support 1, whereby the sifter mats 4 are tensioned. When the support 1 swings back, the inertia means 11 continues its original movement, whereby the sifter mats 4 are relieved of stress or compressed.

The sifting mats 4 begin to be tensioned again only to the degree that the inertia means 11 approaches its dead centre point.

In practice, the inertia means 11 oscillates in phase-shifted relationship with the support construction 1, so that the mats 4 are successively tensioned and compressed. By virtue of the bearing beams 8 being gripped between the spring elements 7, which have the form of shear rubber blocks, the oscillation forces in a vertical direction are severely suppressed so that a substantially linear oscillation movement in a horizontal direction is produced without the requirement for a guide means.

Figure 4:
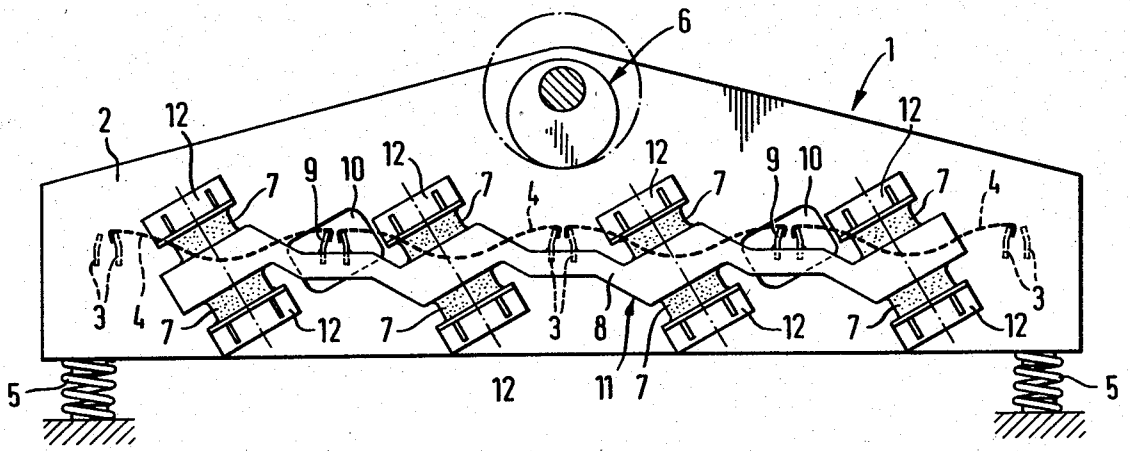
FIG. 4 shows a side view of a second embodiment of a sifter apparatus according to the invention.

In the embodiment shown in FIG. 4, the axes of the spring elements 7 are inclined with respect to the vertical. That arrangement also provides in a simple manner for a conveying action for the material being sifted.

In addition, it is possible to divide the side plates 8 into portions, in the longitudinal direction, and to use spring elements with a different spring rate for each portion, thereby producing amplitudes of oscillation movement which are different over the sifting section.

We claim:

1. A sifter apparatus comprising (a) a support comprising (1) two side plates defining transversely aligned window openings at spaced locations along the side plates and (2) first transverse bearings beams extending between the aligned window openings and connecting the side plates;

(b) means for oscillating the support;

(c) inertia means connected to the support, the inertia means comprising (1) two side bearing beams extending along the two side plates and (2) second transverse beams passing through the aligned window openings in the side plates and connecting the side bearing beams;

(d) spring means comprised of pairs of spring elements connected to the side plates of the support at said spaced locations, the two side bearing beams of the inertia means being gripped between the spring elements of each of said pairs; and (e) sifting mats secured between respective ones of the first and second transverse beams.

2. The sifter apparatus of claim 1, wherein the spring elements have vertically extending axes.

3. The sifter apparatus of claim 1, wherein the spring elements have axes inclined with respect to the vertical.

4. The sifter apparatus of claim 1, wherein the spring elements are rubber blocks.

* * * * *